US006984200B2

(12) United States Patent
Samways

(10) Patent No.: US 6,984,200 B2
(45) Date of Patent: Jan. 10, 2006

(54) CENTRIFUGAL SEPARATOR FOR SEPARATING SOLID CONTAMINANTS FROM A LIQUID, ROTOR FOR USE THEREIN AND METHOD OF SEPARATING CONTAMINANTS FROM LIQUIDS

(75) Inventor: Andrew Leonard Samways, Dorchester (GB)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/615,877

(22) Filed: Jul. 10, 2003

(65) Prior Publication Data

US 2004/0152578 A1 Aug. 5, 2004

Related U.S. Application Data

(63) Continuation of application No. PCT/GB02/00061, filed on Jan. 9, 2002.

(30) Foreign Application Priority Data

Jan. 13, 2001 (GB) ..... 0100989
Jan. 13, 2001 (GB) ..... 0100993

(51) Int. Cl.
*B04B 7/12* (2006.01)
*B04B 9/06* (2006.01)

(52) U.S. Cl. ..... 494/49; 494/65; 494/67

(58) Field of Classification Search ..... 494/24, 494/36, 43, 49, 64, 65, 67, 84, 901; 210/168, 210/171, 232, 360.1, 380.1, 416.5; 184/6.24

See application file for complete search history.

(56) References Cited

U.S. PATENT DOCUMENTS 1,811,157 A 6/1931 Schwerdtfeger (Continued)

FOREIGN PATENT DOCUMENTS

DE 966346 7/1957

OTHER PUBLICATIONS

European Search Report.

(Continued)

*Primary Examiner*—Charles E. Cooley
(74) *Attorney, Agent, or Firm*—Crowell & Moring LLP

(57) ABSTRACT

A centrifugal separator 110 (FIG. 1) for removing contaminants from a pumped liquid such as engine lubricant, having a separation rotor 130 rotatable about axis 124 at high speed by a jet 178 of the liquid impinging upon impulse turbine blades 174. The rotor includes a separation and containment vessel 132 having impervious side wall 134 spaced from the rotation axis and at least one end wall 138 open at 142 permit liquid to leave the vessel as fast as it can enter, so that a zone 140 is defined adjacent side wall 134 that holds a volume of liquid much less than the whole volume encompassed by the vessel walls and filled in conventional high speed separators. Lower inertia and reduced pressure gradients in the liquid permit it to be spaced further from the axis than is conventional, with improved separation efficiency. Liquid may be supplied to zone 140 in any convenient manner but as shown spent turbine liquid 178' is collected on a rotating surface 158 of a divider wall 152 that spreads and/or directs the liquid to transfer passages 164 from which it is flung centrifugally to the separation zone 140. The outer side wall 134 of the vessel which collects contaminants may be a replaceable attachment to the divider wall/turbine part. The rotor may alternatively comprise such a vessel surrounding a conventional, filled canister to effect a radial increase in such rotor without comparable increase in the volume of liquid contained.

14 Claims, 6 Drawing Sheets

U.S. PATENT DOCUMENTS

| | | | | | |
|---|---|---|---|---|---|
| 2,321,144 | A | * | 6/1943 | Jones | 494/15 |
| 2,335,420 | A | * | 11/1943 | Jones | 184/6.24 |
| 3,572,582 | A | | 3/1971 | Seielstad, Jr. | |
| 4,284,504 | A | * | 8/1981 | Alexander et al. | 210/168 |
| 4,346,009 | A | * | 8/1982 | Alexander et al. | 494/38 |
| 4,591,433 | A | | 5/1986 | Budzich | |
| 6,019,717 | A | * | 2/2000 | Herman | 494/49 |
| 6,234,949 | B1 | * | 5/2001 | Cox et al. | 494/49 |
| 6,238,331 | B1 | * | 5/2001 | Cox et al. | 494/49 |
| 2004/0152578 | A1 | * | 8/2004 | Samways | |

FOREIGN PATENT DOCUMENTS

| | | | |
|---|---|---|---|
| DE | 1919976 | * | 1/1971 |
| DE | 19715661 | | 10/1998 |
| EP | 0980714 | | 2/2000 |
| FR | 1089071 | | 12/1953 |
| GB | 732132 | * | 6/1955 |
| GB | 2098098 | | 10/1981 |
| GB | 2297499 | | 8/1996 |
| GB | 2314036 | | 12/1997 |
| GB | 2328891 | | 3/1999 |
| GB | 278161 | * | 10/2004 |
| WO | 86/06984 | | 12/1986 |
| WO | 98/36846 | * | 8/1998 |

OTHER PUBLICATIONS

International Search Report.

* cited by examiner

CENTRIFUGAL SEPARATOR FOR SEPARATING SOLID CONTAMINANTS FROM A LIQUID, ROTOR FOR USE THEREIN AND METHOD OF SEPARATING CONTAMINANTS FROM LIQUIDS

CROSS REFERENCE TO RELATED APPLICATIONS

This application is a continuation of international patent application no. PCT/GB02/00061, filed Jan. 9, 2002, designating the United States of America and published in English on Jul. 18, 2002 as WO 02/055207, the entire disclosure of which is incorporated herein by reference. Priority is claimed based on United Kingdom patent applications nos. GB 0100989.3 and GB 0100993.5, both filed Jan. 13, 2001.

BACKGROUND OF THE INVENTION

The present invention relates to centrifugal separation apparatus for separating particulate contaminants from liquids, such as engine lubricants, passed therethrough to effect cleaning, and in particular relates to rotor means used within such apparatus to perform the actual separation and retention of such contaminants.

Centrifugal separation apparatus is well known for use within the lubrication systems of vehicle internal combustion engines as efficient means for removing very small particulate contaminants from the constantly recirculated liquid lubricant over a long period of operation, such particulate contaminants arising from abrasion of the metallic components of the engine, decomposition of the lubricant and products of combustion.

Such centrifugal separation apparatus is sometimes known as being of the sedimenting, solid-wall type in which separated solids are retained within the rotor means as a sediment against an impervious radially outer side wall thereof, and distinct from the so-called filtering perforate-wall type in which the solids are held by the mesh of a perforate radially outer side wall while liquid passes therethrough.

Insofar as such separators are responsible for cleaning a liquid which is in any event circulated at elevated pressure, the art has concentrated on employing such lubricant pressure to effect rotation of parts responsible for generating centrifugal forces, and as such it includes rotor means comprising an essentially closed vessel, or canister, being supported for rotation about a rotation axis within a housing, and supplied with the liquid lubricant at elevated pressure at the axis. The canister is filled with the liquid and assumes a significant internal pressure before liquid is forced from the base (or other peripheral wall) of the canister by way of tangentially directed jet reaction nozzles, the reaction to said ejection causing the rotor canister and liquid within it to spin at high speed about the axis and thereby force solid particles to migrate from the liquid passing through the canister and agglomerate into a cohesive mass on the peripheral walls spaced from the rotation axis. The reaction nozzles, being directed substantially tangentially with respect to the rotation axis, at least in a plane orthogonal to the axis, define a reaction turbine.

It will be appreciated that the efficiency of separation is inter alia dependant upon creating the conditions in which any liquid entrained particle can migrate radially to the nearest deposition surface and is a function of the force acting on such particle and the time for which it can act. The former is a function of rotation rate and distance from the rotation axis. The latter is a function of the time taken for the entraining liquid to pass through the rotor canister (also called the residence time) and the proximity of the deposition surface, and may be considered in terms of an effective residence time, that is, influencing the contribution of the actual residence time by positioning the contaminated liquid relatively to an appropriate deposition surface. However both the rotation speed of the rotor canister and contained liquid, and the rate at which liquid is passed through and ejected therefrom, are dependant upon the pressure drop between the canister contents and housing and upon the dimensions of the nozzles, within the constraints of such nozzle dimensions providing sufficient torque from the turbine to overcome inertial and frictional resistance to commencement of, and continuation of, rotation.

Within an internal combustion engine where lubricant is circulated under an initial (pumped) pressure in a range of about 2 to 6 bars that varies with operating conditions, a canister of relatively modest diameter, say 10 to 15 cms, and reaction turbine nozzles may achieve a rotation speed in the range of 4000 to 9000 r.p.m. which is sufficient for removing the relatively dense, contaminants of lubricant residue and metallic particles traditionally considered to be of principal detriment to the engine.

Examples of such reaction turbine centrifugal separation are shown in GB 745377, GB 2328891, U.S. Pat. No. 5,575,912 and U.S. Pat. No. 5,906,733, and it can be seen that as developments have been made to increase efficiency of separation, and range of separability, the degree of structural complexity has also increased, not least in optimizing effective residence time and/or placing the liquid to maximize forces acting upon entrained contaminants for the limited rotation forces available.

This is particularly true in respect of the dual goals of deriving maximum rotation energy from the liquid passing through the rotor whilst providing therein conditions necessary and suited to centrifugal separation of low density contaminant particles such as soot. Such contaminants are now seen as an important cause of engine wear, particularly in compression ignition engines, and require the lubricant to be provided with greater effective residence time and/or be subjected to greater centrifugal forces than hitherto, notwithstanding that providing such conditions in these arrangements also tend to militate against efficient flow of liquid through the canister.

Obtaining greater rotation rate from such a reaction turbine necessitates ejecting liquid at a greater rate, by increasing the pressure and/or by shortening the residence time or by increasing the volume of liquid contained, whereas attempting to cause the contaminant entraining liquid to traverse the canister at a greater radial distance from the axis is made difficult by the fact that the rotating liquid content of the canister creates a radial pressure gradient tendering to keep newly introduced liquid away from the radially outer region of maximum centrifugal force (unless internal structures are provided that add to the complexity and/or consume energy from the rotation). Therefore, optimizing such rotor canister is not a matter of simply increasing the radial dimensions of the canister but effecting a compromise that nevertheless includes containing within the canister at high pressure a relatively large volume of the liquid lubricant to enable it to have a significant effective residence time while it follows a tortuous path that involves interchanging potential and kinetic energy until it is ejected with sufficient energy for rotation production.

U.S. Pat. No. 6,017,300 in particular explains in some detail that for properly separating very lightweight soot particles that can contaminate the liquid lubricant as products of combustion, the particles have to be subjected to higher centrifugal forces than readily available from such traditional, reaction turbine drive centrifugal separation arrangements, along with a longer residence time, and proposes to elaborate upon the complex cone stack arrangement of U.S. Pat. No. 5,575,912 by an external impulse turbine, the latter providing for high rotation operation and, being separate from the liquid for cleaning in the container, permits the contaminated liquid to have a longer residence time.

Separating low density contaminants from constant streams of high pressure liquid is not the only situation for which traditional centrifugal separator designs are inadequate. For example, as described in U.S. Pat. No. 5,906,733 where the liquid to be cleaned is derived only indirectly from a high pressure circulation, either at low pressure or intermittently, a separate flow of the high pressure liquid is employed to effect rotation of the canister whilst the liquid to be cleaned can flow through at lower pressure and/or at lower rate, the separate flow of liquid effecting rotation by way of direct reaction jet nozzles in the container or as an impulse turbine employing external blades against which liquid is directed from stationary nozzles.

Insofar as these modified designs still adopt the principle of defining a rotor vessel whose radial dimensions are optimized for centrifugal forces on liquid entrained particles and function by filling it with the contaminated liquid and then effecting rotation at appropriate speed, they still exhibit significant rotor vessel inertia and have to provide energy to overcome frictional and other bosses, providing a slow response, particularly in start-stop situations.

SUMMARY OF THE INVENTION

It is an object of the present invention to provide an improved centrifugal separation rotor for centrifugal separation apparatus which mitigates disadvantages of known designs.

Another object of the invention is to provide a centrifugal separation rotor which is suitable for separating low density particulate contaminants from circulated lubricant of an internal combustion engine.

It is also an object of the invention to provide centrifugal separation apparatus including such rotor means.

It is furthermore an object of the present invention to provide a method of centrifugal separation which mitigates disadvantages associated with known methods.

These and other objects of the invention are achieved by providing a centrifugal separation rotor for a centrifugal separator for separating solid contaminants from a liquid, the separator comprising a housing for mounting the rotor for rotation about a rotation axis by a drive, the rotor comprising a walled separation and containment vessel having an impervious radially outer side wall extending about and along the rotation axis to form radially inwardly from the side wall an annular contaminant separation and containment zone; an outlet passage, disposed radially inwardly with respect to the radially outer side wall and leading externally of the vessel to define, during rotation, the radial boundary of the annular contaminant separation and containment zone, and, associated with the vessel; an inlet for conveying liquid to be cleaned to the contaminant separation and containment zone at a rate less than the liquid can be discharged by the outlet passage, the inlet comprising a liquid collector, defining an inlet region about the rotation axis radially inwardly of the outlet passage, and a transfer passage communicating between the inlet region and the contaminant separation and containment zone of the vessel spaced axially from the outlet passage; wherein the liquid collector comprises a divider wall, extending about and along the rotation axis and defining at least in part at one end thereof the transfer passage, having a liquid collection face, facing towards the rotation axis, arranged to receive liquid introduced into the inlet at a part spaced axially from the transfer passage and operable to support the liquid radially in response to centrifugal force exerted by rotation, permitting it to flow along the wall to the transfer passage, and wherein the divider wall collection face increases in radial distance from the rotation axis along its length from the liquid introduction part to the transfer passage, the increase being arranged to cause, in operation, a component of the centrifugal force to confine axial flow of the contaminated liquid over the collection face in a direction towards the transfer passage.

In accordance with a further aspect of the invention, the objects are achieved by providing a centrifugal separation rotor for a centrifugal separator for separating solid contaminants from a liquid, the separator comprising a housing for mounting the rotor for rotation about a rotation axis by drive, the rotor comprising a walled separation and containment vessel having an impervious radially outer side wall extending about and along the rotation axis to form radially inwardly from the side wall an annular contaminant separation and containment zone; an outlet passage disposed radially inwardly with respect to the radially outer side wall and leading externally of the vessel to define, during rotation, a radial boundary of the annular contaminant separation and containment zone; an inlet for conveying a liquid to be cleaned to the contaminant separation and containment zone at a rate less than the liquid can be passed through the outlet passage, the inlet comprising a liquid collector defining an inlet region about the rotation axis radially inwardly of the outlet passage, and a transfer passage communicating between the inlet region and the contaminant separation and containment zone of the vessel spaced axially from the outlet passage; and at least one further separation and containment vessel associated with the separation and containment vessel and nested radially inwardly of the contaminant separation and containment zone, the further separation and containment vessel having an impervious radially outer side wall, an annular contaminant separation and containment zone bounded radially inwardly of the side wall by an outlet passage, and an inlet arranged to convey liquid to the annular zone at a rate less than the liquid can be discharged from the annular zone through the outlet passage, each further separation and containment vessel being disposed such that the outlet passage of each surrounded vessel permits liquid to be conveyed radially by centrifugal forces to the next surrounding vessel.

In yet another aspect, the objects are achieved by providing a centrifugal separation rotor for a centrifugal separator for separating solid contaminants from a liquid, the separator comprising a housing for mounting the rotor for rotation about a rotation axis by drive, the rotor comprising a walled separation and containment vessel having an impervious radially outer side wall extending about and along the rotation axis to form radially inwardly from the side wall an annular contaminant separation and containment zone; an outlet passage disposed radially inwardly with respect to the radially outer side wall and leading externally of the vessel to define, during rotation, a radial boundary of the annular contaminant separation and containment zone; an inlet associated with the vessel for conveying a liquid to be cleaned to the contaminant separation and containment zone at a rate less than the liquid can be discharged through the outlet passage, the inlet comprising a liquid collector defining an inlet region about the rotation axis radially inwardly of the outlet passage, and a transfer passage communicating between the inlet region and the contaminant separation and containment zone of the vessel spaced axially from the outlet passage; and a further walled separation and containment vessel coupled to the walled containment and separation vessel for rotation therewith, the further walled separation and containment vessel defining a canister having an outlet passage and an inlet passage having a greater flow capacity than the outlet passage and capable of admitting liquid to the vessel at a rate greater than it can pass through the outlet passage so that the vessel is maintained filled in operation, and having an impervious radially outer side wall extending around and along the rotation axis and forming an annular contaminant separation and containment zone extending radially inwardly from the side wall.

In a still further aspect, the objects are achieved by providing a centrifugal separator for separating solid contaminants from a liquid, the separator comprising a housing, an inlet opening into the housing for supplying contaminated liquid to the housing at elevated pressure, an outlet for discharging cleaned liquid from the housing, a rotor mounted within the housing for rotation about a rotation axis extending through the housing, and a drive for rotating the rotor about the rotation axis, wherein the rotor comprises a centrifugal separation rotor as described above.

The objects of the invention are also achieved at least in part by providing a method of separating solid contaminants from a liquid using centrifugal forces, comprising rotating about an axis a vessel having an impervious radially outer side wall displaced from the axis and an outlet passage communicating with the vessel radially inwardly of the outer side wall; introducing liquid to be cleaned to the rotating vessel at a rate not greater than the outlet passage is capable of discharging liquid from the vessel such that the liquid occupies a separation and containment zone bounded by the radially outer side wall and the outlet passage, wherein the liquid is conveyed to a collector face which faces the rotation axis, the collector face being disposed radially inwardly of the separation and containment zone and communicating with the zone via at least one transfer passage, and rotating the collector face about the axis to generate sufficient centrifugal force to maintain the introduced liquid bearing against the collector face and cause liquid flow along the collector face to the at least one transfer passage; wherein the liquid at the collector face is subjected to a component of the centrifugal force in a direction along the collector face towards the at least one transfer passage by increasing the distance of the collector face from the rotation axis in a direction along the axis towards the transfer passage, thereby causing the liquid to flow along the collector face only towards the transfer passage.

It should be understood in accordance with the invention that any centrifugal separation apparatus which effectively separates low density contaminants is also able to separate relatively high density contaminants mixed therewith or be combined with apparatus optimized for separation of such relatively high density contaminants.

According to a first aspect of the present invention centrifugal separation rotor means for centrifugal separation apparatus of the type for separating solid contaminants from a liquid and comprising a housing for mounting the rotor means for rotation about a rotation axis by drive means, wherein the rotor means comprises a walled separation and containment vessel having an impervious radially outer side wall extending about and along the rotation axis to form radially inwardly from the side wall an annular contaminant separation and containment zone, outlet passage means leading externally of the vessel and, associated with the vessel, inlet means operable to convey liquid to be cleaned to the contaminant separation and containment zone, is characterized by said vessel outlet passage means being capable of passing liquid from the vessel at a rate greater than the associated inlet means can convey it to the vessel and disposed radially inwardly with respect to the radially outer side wall to define, during rotation, the radial boundary of the annular contaminant separation and containment zone, to which zone said liquid and contaminants separated therefrom are confined in the vessel.

According to a second aspect of the present invention a separation and containment module for centrifugal separation rotor means of the type for separating solid contaminants from a liquid passed therethrough when driven about a rotation axis and wherein the rotor means has a walled separation and containment vessel with an impervious radially outer side wall, extending about and along the rotation axis and forming radially inwardly of the side wall an annular contaminant separation and containment zone arranged to be supplied with contaminated liquid from associated inlet means, and outlet passage means communicating with the vessel radially inwardly of the outer side wall, comprises at least said vessel impervious radially outer side wall defined about, and spaced radially from, a longitudinal axis, the outlet passage means and means to releasably attach the module coaxially with respect to the rotation axis and define thereabout the outlet passage means able to pass liquid at a rate greater than it can be conveyed to the vessel and adjacent the outer side wall the annular separation and containment zone to which the substantially all of the liquid in the vessel is confined during rotation.

The operationally partially filled separation and containment vessel defined in the two preceeding paragraphs means may comprise the vessel only or may have coupled thereto a further walled separation and containment vessel defining a canister having outlet passage means and inlet passage means having greater flow capacity than the outlet passage means to convey liquid to the vessel and maintain it filled in operation, and an impervious radially outer side wall extending around and along the rotation axis and forming an annular contaminant separation and containment zone extending radially inwardly from the side wall.

According to a third aspect of the present invention a separation and containment module for centrifugal separation rotor means, of the type comprising a canister for separating solid contaminants from a liquid passed therethrough when driven about a rotation axis, and wherein the canister has a substantially impervious radially outer side wall extending around and along the rotation axis and outlet passage means arranged not to pass liquid from the vessel at a greater rate than conveyed thereto and cause the vessel to be filled in operation, and form an annular contaminant separation and containment zone radially inwardly of the outer side wall, comprises a walled separation and containment vessel having a longitudinal axis, an impervious radially outer side wall extending about and along the longitudinal axis to receive liquid conveyed thereto, outlet passage means communicating with the vessel radially inwardly of the outer side wall, able to pass liquid at a rate greater than it can be conveyed to the vessel, and means to releasably attach the module co-axially with respect to the canister to define thereabout the outlet passage means and adjacent the outer side wall an annular separation and containment zone to which the substantially all of the liquid in the vessel is confined during rotation.

According to a fourth aspect of the present invention centrifugal separation apparatus for separating solid contaminant from a liquid comprises a housing into which extends inlet duct means for supplying contaminated liquid thereto at elevated pressure and outlet duct means for drainage of cleaned liquid therefrom, rotor means, mounted within the housing for rotation about a rotation axis and is characterized by the centrifugal separation rotor means or separation and containment module defined in any of the preceding four paragraphs.

According to a fifth aspect of the present invention a method of separating solid contaminants from a liquid using centrifugal forces comprises rotating about an axis a vessel having an impervious radially outer side wall displaced from the axis and outlet passage means communicating with the vessel radially inwardly of the outer side wall, conveying liquid to be cleaned to the vessel and passing clean liquid from the vessel by said outlet passage means, the method being characterized by defining an annular contaminant separation and containment zone in the vessel bounded radially by the side wall and the outlet passage means, conveying liquid to the zone at a rate not greater than the outlet passage means is capable of passing and rotating the vessel about the axis at such a rate that liquid within the vessel occupies substantially all of, and is confined to, the separation and containment zone.

According to a sixth aspect of the present invention a method of improving the separation performance of a centrifugal separator having centrifugal separation rotor means mounted for rotation and supplied with liquid at elevated pressure and passed through a canister thereof at such a rate as to keep it filled, is characterized by disposing coaxially with respect to the canister and coupled for rotation therewith, a separation and containment vessel having an impervious radially outer side wall displaced from the axis and outlet passage means communicating with the vessel radially inwardly of the outer side wall, defining an annular separation and containment zone in the vessel bounded radially by the side wall and outlet passage means, conveying liquid to be cleaned to the separation and containment zone at a rate not greater than the outlet passage means is capable of passing and rotating the canister and vessel about the axis at such a rate that liquid within the vessel occupies substantially all of, and is confined to, the annular separation and containment zone displaced radially outwardly of the canister.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
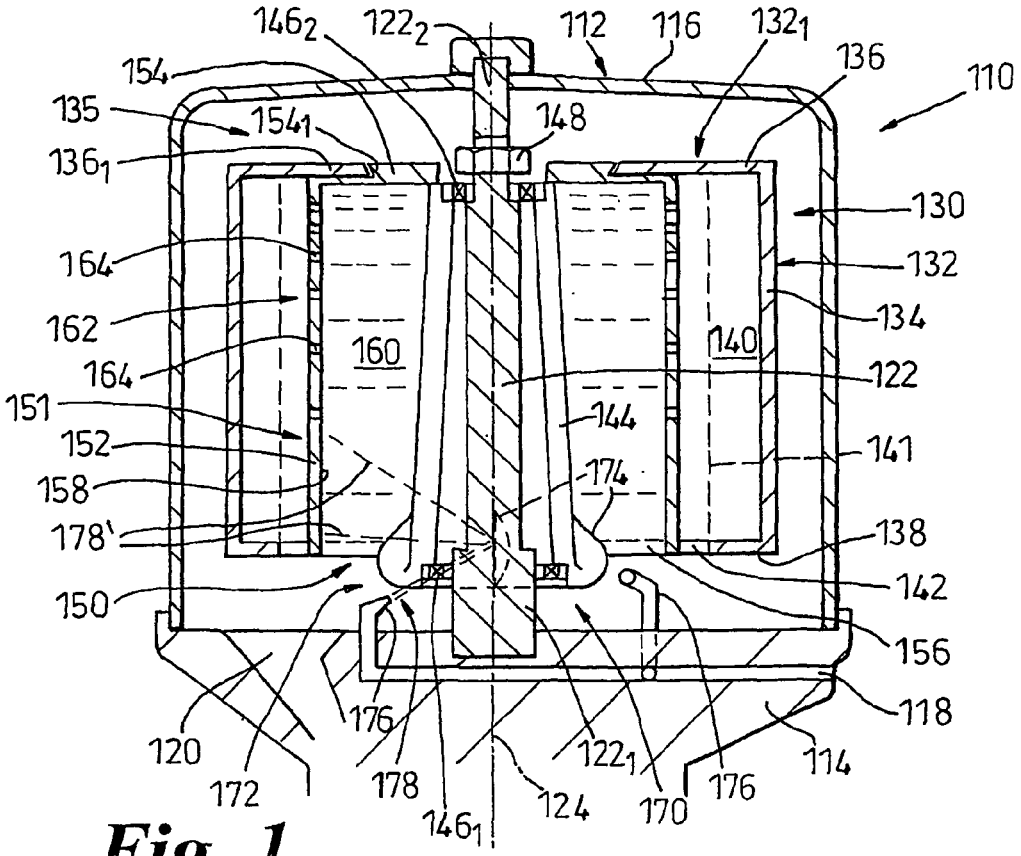
FIG. 1 is a sectional elevation through a first embodiment of centrifugal separation apparatus in accordance with the invention, including impulse turbine drive means as the source of contaminated liquid and inlet means in the form of an axially extending, perforated divider wall.

Referring to FIG. 1, a first embodiment of centrifugal separator 110 comprises a housing 112 defined by a base 114, adapted to be affixed to the engine block of an internal combustion engine (not shown), and a removable cover 116. The base includes inlet duct means 118, by which contaminated liquid is supplied at elevated pressure, and outlet duct means 120 for drainage of liquid from the housing to the engine sump.

A spindle 122, having longitudinal axis 124, is supported at one end thereof $\mathbf{122}_1$ by the base and extends through the housing and engages at its other end $\mathbf{122}_2$ with the cover 116.

Mounted on the spindle for rotation about the axis 124 within the housing is rotor means 130, comprising a walled containment separation and containment vessel 132 (hereafter referred as "the vessel") which has an impervious, radially outer side wall 134 extending about, and lengthways of, rotation axis 124 between end walls 136 and 138. Radially inwardly from the side wall 134 is an annular contaminant separation and containment zone 140 (hereafter referred to as "the zone"), the radially inner boundary of the zone, as denoted by the broken line 141, being defined by outlet passage means 142 in the end wall 138 which leads externally of the vessel within the housing. The outlet passage means 142 may comprise one or more apertures, in the form of circumferentially extending slots, in the end wall or may comprise an annular gap representing a radial space between the end wall 138 and inlet means, indicated generally at 150 and described hereinafter, which is arranged to convey contaminated liquid from radially inwardly thereof to the zone 140.

The rotor means is mounted with respect to the spindle 122 by way of a tubular axle 144 which surrounds the spindle and is mounted by axially spaced needle roller bearings $\mathbf{146}_1$, $\mathbf{146}_2$, or equivalent low friction bearings, and held captive by a nut 148.

The inlet means 150 comprises collection means 151 having a divider wall 152, also extending about and lengthways of the rotation axis 124, disposed radially between the tubular axle 144 and the zone 140, preferably adjacent the latter and possibly defining one boundary of the outlet passage means 142. The divider wall 152 is mounted in fixed relationship to the tubular axle, at one of its axial extremities by radially extending wall 154 and at the other, optionally, by bracing spars 156, but nevertheless apertured for drainage and possibly absent altogether. The wall 152 has an inlet or collection face 158 facing towards the rotation axis and defining between the face and the tube axle 146 an inlet region 160.

Transfer passage means, indicated generally at 162, communicates between the collection face 158 and the zone 140, taking the form of a plurality of through-apertures 164 in the divider wall. Preferably the apertures are concentrated in density towards the end of the divider wall axially remote from the outlet passage means but at any axial position are uniformly distributed circumferentially.

With the tubular axle 144, the divider wall 152 and the end wall 154, form the main structural element of the rotor means by which it is carried on the spindle and with respect to the housing.

The radially outer wall 134 and end walls 136 and 138, which define the contaminant separation and containment zone 140 and outlet passage means 142, are formed as a discrete separation and containment module $\mathbf{132}_1$ arranged to be removably mounted with respect to the inlet means 150 by means, indicated at 135 comprising a radially overhanging lip $\mathbf{154}_1$ of the end wall 154 engageable with the radially inner edge $\mathbf{136}_1$ of the end wall 136. The module $\mathbf{132}_1$ is conveniently molded of synthetic resin material (i.e., plastic) and may include any conventional strengthening features, such as circumferential ribs to enable it to withstand the stresses of high speed rotation and the forces exerted by the liquid and deposited contaminants in the zone 140.

The inlet means 150 also collects contaminated liquid to be cleaned on the collection face, which it does by way of rotor drive means, indicated generally at 170. The drive means comprises a fluid motor in the form of an impulse turbine 172. The impulse turbine 172 comprises a plurality of turbine blades 174, each of which may have a concave, bucket-like form also known as a Pelton wheel, arrayed surrounding the rotation axis 124 and fixed with respect to the rotor means. The blades may individually, or as an array sub-assembly, be secured to an end region of the tube axle 144 or formed integrally therewith as shown.

The turbine 172 also comprises a plurality of liquid jet nozzles 176, each of which extends from the base 114 and is coupled to the high pressure supply duct 118 to direct a jet 178 of the contaminated liquid at a particular bucket position, substantially tangentially with respect to the rotation axis but also inclined longitudinally with respect thereto such that liquid deflected by, or otherwise splashed after, impact with a blade is caused to enter inlet region 160 and impinge upon the collection face 158 of the inlet means, as illustrated by broken boundary lines 178'.

Thus, in operation contaminated liquid supplied to the arrangement initially uses its energy to effect high speed rotation of the rotor means including the collection face 158, so that spent turbine liquid which impinges upon the collection face is spread into a covering film by the centrifugal forces of rotation. Liquid of the film passes through the apertures 162 of the passage means and is thrown towards the radially outer wall 134.

The turbine means is arranged in conjunction with the outlet passage means to ensure that contaminated liquid is supplied to the collection face 158 at a rate less than that at which it can drain through the outlet passage means 142, so that a layer of liquid and contaminants is held against the outer wall 134 to a thickness no greater than the contaminant separation and containment zone 140 defined by the radial position of the outlet passage means and the vessel is otherwise substantially empty. Insofar as such zone is at maximum distance from the rotation axis, centrifugal forces are at maximum and any heavier contaminants are separated from the liquid to agglomerate into a layer against the wall with the liquid overlying it. Separation can thus continue until the contaminant deposits fill the zone and further contaminants are washed directly through the outlet passage means.

Thereafter, separation and contaminant module $\mathbf{132}_1$ can readily be separated from the inlet means and cleaned or discarded, being replaced with a cleaned or new module. As indicated above the module may be manufactured from molded synthetic resin material which enables it to be manufactured cheaply as a "consumable" which can readily be destroyed with the contaminants collected therein and which reduces the inertia of the rotor means in operation.

In keeping with reducing the inertia of the rotor means, it is an important feature of the invention that in operation the vessel of the rotor means is not filled with the liquid, unlike the normal operating conditions of such cleaning arrangements, and rapidly brought up to operating speed by direct turbine drive and without awaiting for the rotor to fill with liquid. Also, because in this embodiment the tubular axle is not filled with liquid at elevated pressure, the bearings $\mathbf{146}_1$ and $\mathbf{146}_2$ may be chosen for low energy loss without regard to liquid containment.

Many of the individual components may take alternative form, and in general may be varied independently of each other.

Figure 2:
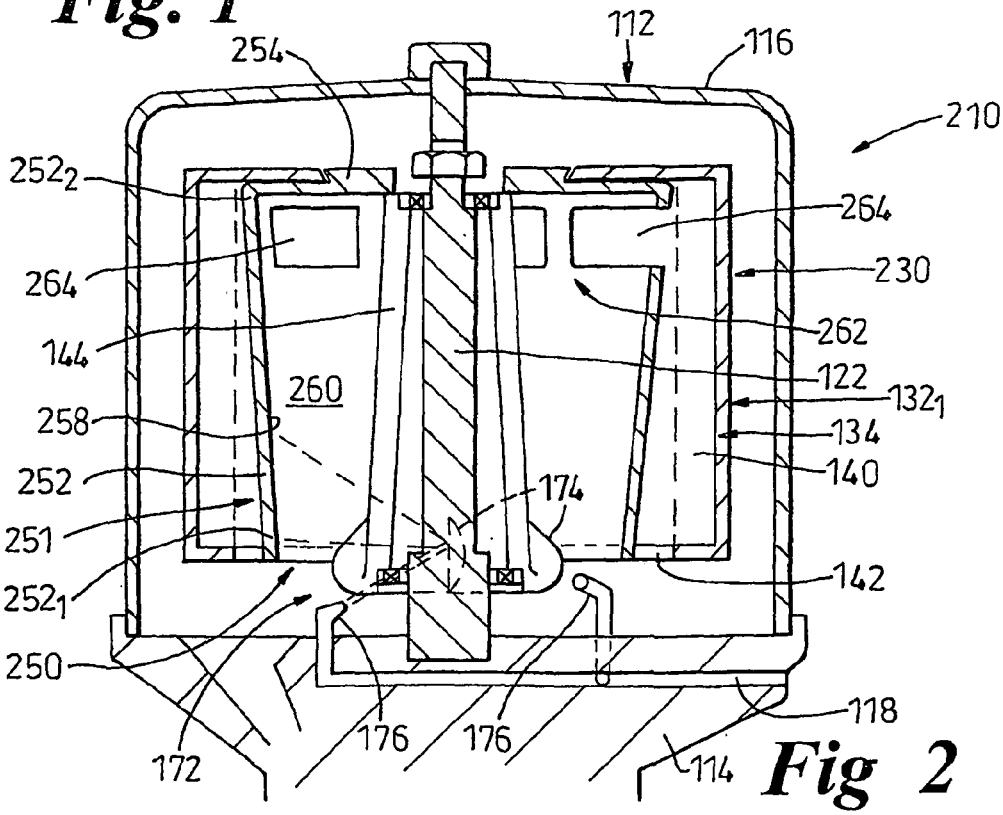
FIG. 2 is a sectional elevation through a second embodiment of centrifugal separation apparatus in accordance with the invention, illustrating a divider wall of tapered form.

Referring now to FIG. 2, this shows in similar sectional elevation a second embodiment of centrifugal separator 210 which illustrates one such variant. Identical components retain the same reference numbers and corresponding, but different components have reference numbers with a leading "2".

The separator 210 comprises the aforementioned housing 112 defined by base 114 cover 116 and spindle 122. Housed rotor means 230 is substantially the same as rotor means 130 except in respect of inlet means 250 which includes collection means 251 having a divider wall 252 of slightly conical form, increasing in radius with distance from the end $\mathbf{252}_1$ at which liquid is introduced towards end $252_2$ adjacent wall 254 and defining a similarly shaped inlet region 260. Also, instead of aperture means in the form of an array of through-apertures scattered radially and axially thereof, aperture means 262 comprises circumferentially extending slots 264 disposed only towards the end of maximum radius.

Impulse turbine drive means 172 is as described above, and contaminated liquid is directed by nozzles 176 towards impulse turbine blades 174 to effect rotation of the rotor means and spent liquid is directed on to collection face 258 of the divider wall. As described above, the centrifugal forces of rotation spread the liquid as a film over the collection face and here the variation in radius encourages the liquid to migrate to the upper end $252_2$, whereupon it passes through slots 264 and is flung toward the outer wall 134 of the module $132_1$. Insofar as the liquid enters the contaminant separation and containment zone 140 at the end remote from the outlet passage means 142, it is caused to dwell in the zone for the maximum possible separation time.

Figure 3:
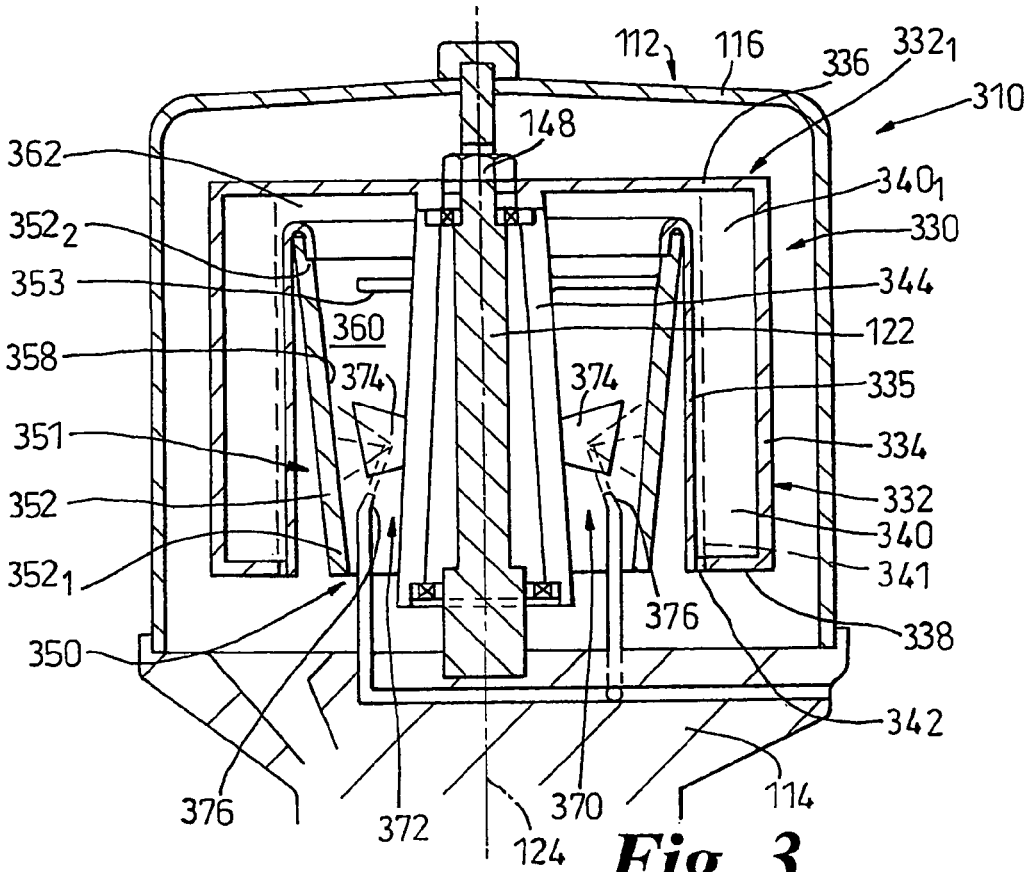
FIG. 3 is a sectional elevation through a third embodiment of centrifugal separation apparatus in accordance with the invention illustrating variants of components.

Other components and structural relationships may be employed without departing from the spirit of the invention and FIG. 3 shows in sectional elevation a third embodiment of centrifugal separator 310 which illustrates possible variants. Components identical to those of the first and second embodiments have the same reference numbers whilst differing components have reference numbers with a leading "3".

The separator 310 comprises the aforementioned housing 112 defined by base 114 cover means 116 and spindle 122, the latter defining rotation axis 124. Housed rotor means 330 is mounted on the spindle 122 by tubular axle 344.

The rotor means comprises a walled vessel 332 bounded externally by impervious outer side wall 334 extending about, and lengthways of, the rotation axis between end walls 336 and 338. The end wall 336 is clamped with respect to the end of the axle means by nut 148 which also locks the tubular axle onto the spindle.

The end wall 338 contains therein outlet passage means 342 displaced radially inwardly of the side wall 334 to define between the passage means as said side wall a contaminant separation and containment zone 340 as indicated by broken lines 341. Displaced radially inwardly of the outlet passage means and extending substantially parallel to the outer wall 334 is an optional inner wall 335 which defines a physically bounded separation and collection chamber $340_1$ of separated contaminants little greater than the 340.

Inlet means 350 includes collection means 351 having a divider wall 352 which surrounds and extends axially of, the rotation axis 124, and the tubular axle 344, being disposed with respect to the tubular axle by spars 353. The divider wall is tapered, increasing in radius as a function of distance from the end $352_1$ adjacent base 114, and otherwise open at its upper end $352_2$ which is spaced axially from the end wall 336 so as to provide a substantially unobstructed annular transfer passage means 362 between collection face 358 of the divider wall and the contaminant separation and containment zone 340 at the outer wall 334.

As a matter of structural convenience and to impart operational strength thereto, the upper end of the inner chamber wall 335 is shaped to locate over the upper end $352_2$ of the divider wall 352.

Furthermore, and illustrative of a further variant, drive means 370 takes the form of an impulse turbine 372 having stationary liquid jet nozzles 376 and generally flat blades 374 fixed with respect to the tubular axle between its ends so that substantially all of the spent turbine drive liquid impinges upon collection face 358 of the divider wall.

Operation is substantially as described above, with contaminated liquid supplied at elevated pressure to supply duct 118 from where it is directed by nozzles 376 towards turbine blades 374 to effect rotation; spent liquid, deflected by the turbine blades to impinge upon the conical collection face 358, is held there by centrifugal forces of rotation and migrates towards the upper end $352_2$ of the divider wall before being flung by these centrifugal forces through the annular gap 362 towards outer wall 334, whereupon it further spreads and flows generally towards outlet passage 342, heavier contaminants being separated from the liquid and caused to agglomerate against, and bond to, the wall or any previously separated contaminants.

When the zone 340 is filled by the separated contaminants, the separation and containment module $332_1$ is readily removed from the rotor means by releasing nut 148 and replaced with an empty one. The optional inner wall 335 effectively prevents any inadvertent dislodging of the deposited contaminants from the outer side wall 334, and as described above, the separation and containment module $332_1$ may be formed as a discardable molded synthetic resin article.

In all of the above described embodiments the drive means for the rotor means is an impulse turbine having blades fixed to a tubular axle surrounding a stationary spindle and supplied with liquid by stationary feed nozzles.

Figure 4:
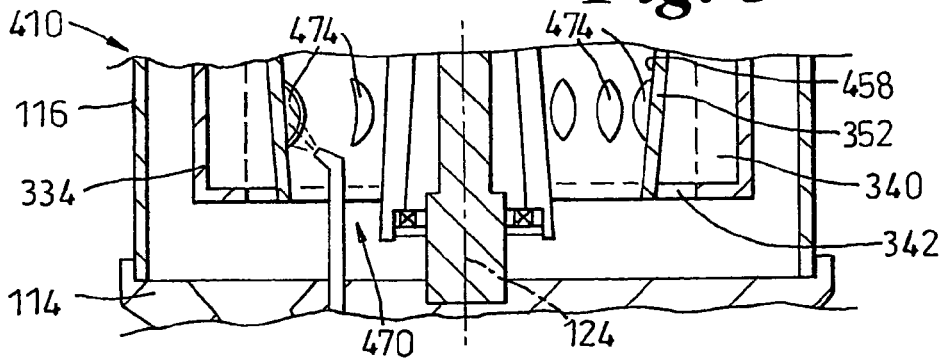
FIG. 4 is a sectional elevation through a part of a fourth embodiment of centrifugal separation apparatus in accordance with the invention illustrating a variant of impulse turbine drive means.

Considering further structural variants, such impulse turbine blades (whether flat or bucket-like) may be mounted elsewhere, provided the spent liquid impinges directly or indirectly upon the collection face of the divider wall. Referring to FIG. 4, in which is illustrated in sectional elevation a part of a fourth embodiment of separation apparatus 410, this is the same as the third embodiment except for drive means 470 in the form of an array of bucket-like turbine blades 474 mounted directly on collection face 458 of the divider wall.

Figure 5:
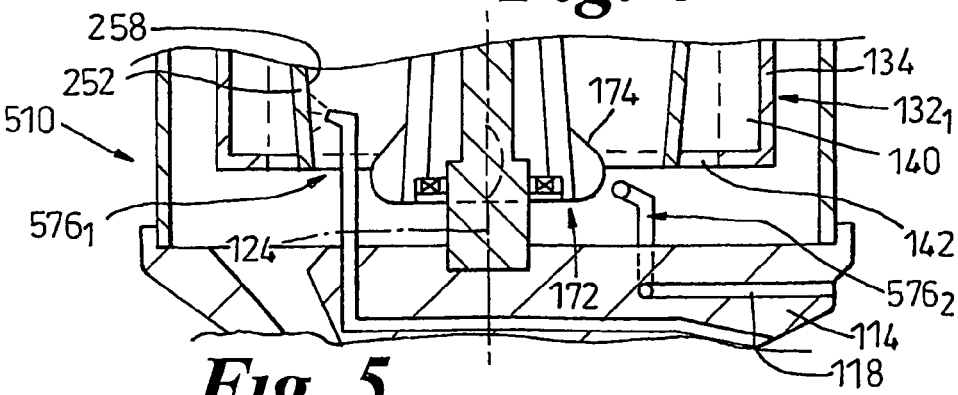
FIG. 5 is a sectional elevation through a part of a fifth embodiment of centrifugal separation apparatus in accordance with the invention illustrating a further variant of impulse turbine drive means in which the spent liquid is not the source of the contaminated liquid to be cleaned.

Referring now to FIG. 5, this shows in sectional elevation part of a fifth embodiment of centrifugal separation arrangement 510 that is generally similar to the separation arrangement 210 in respect of the inlet means and impulse turbine, but wherein the liquid to be cleaned is directed totally or in part directly upon the collection face 258 of divider wall 252 by way of feed nozzle means $576_1$ and the turbine operated in isolation therefrom or in conjunction therewith, being fed by nozzle means $576_2$, to effect rotation of the rotor means at an appropriate high rate. It also illustrates the possibility of supplying contaminated liquid to feed nozzle $576_1$ completely independently from the supply to nozzle means $567_2$, although of course they may have a common supply as described above. It may be advantageous to have such discrete supplies when for instance, the liquid to be cleaned is heavily contaminated and unsuitable for passing through a relatively small nozzle jet for driving the turbine and/or is available at a low or variable pressure or intermittently, such as in the circumstances discussed in the aforementioned U.S. Pat. No. 5,906,733.

Figure 6:
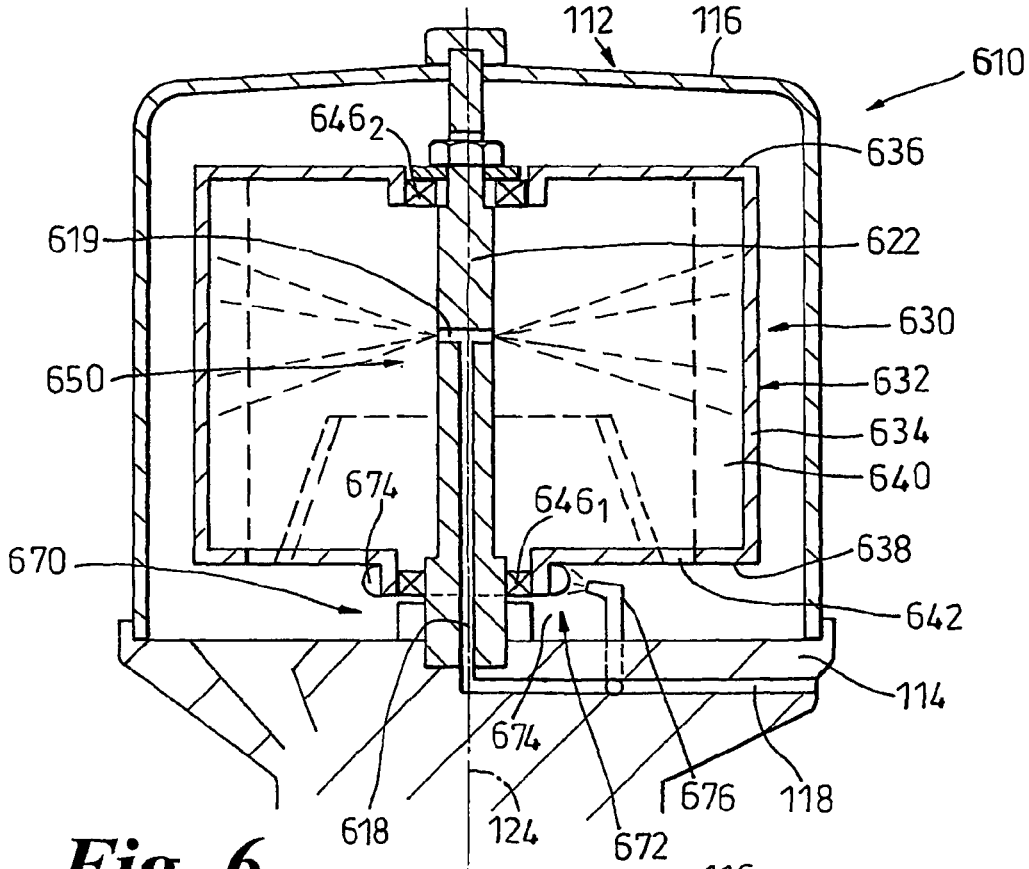
FIG. 6 is a sectional elevation through a sixth embodiment of centrifugal separation apparatus in accordance with the invention illustrating a further variant of inlet means.

Referring to FIG. 6, a sixth embodiment of centrifugal separator 610 is shown in sectional elevation and once more, previously described parts have the same reference numbers whilst parts unique to the embodiment have reference numbers with a leading "6". The housing 112, with base 114 and cover 116, is as described above. Spindle 622 corresponds to the above-described spindle 122 except that it has the supply duct 118 extending axially therealong as inlet passage 618 to cross drillings 619.

Rotor means 630 mounted on the spindle comprises a separation and containment vessel 632 having a side wall 634, extending about and along the rotation axis 124, and radially directed end walls 636 and 638. The side wall defines one radial limit of contaminant separation and containment zone 640, the other radial limit being defined by outlet passage means 642 in the end wall 638. Bearings $646_1$ and $646_2$ carried by said end walls mount the vessel rotatably on the spindle without the need for a separate, tubular axle.

Inlet means, by which contaminated liquid is fed to the zone 640, is indicated generally at 650, comprising the spindle passage 618 and cross drilling 619 which deliver the liquid directly into the vessel and directed towards the zone 640 and without the intermediary of a divider wall, although for comparison with the above described embodiments, the spindle surrounding the passage 618 may be considered to form the divider wall and the cross drilling 619 to form the transfer passage means.

Drive means, indicated generally at 670, comprises impulse turbine 672 of blades 674 and tangentially directed feed nozzle 676.

As with the fifth embodiment, the liquid to be cleaned within the vessel is separate from that of the drive means, although from the same supply duct 118, and permits the flow of each to be optimized. The supplies could, of course, be separate as illustrated by the sixth embodiment.

Figure 7:
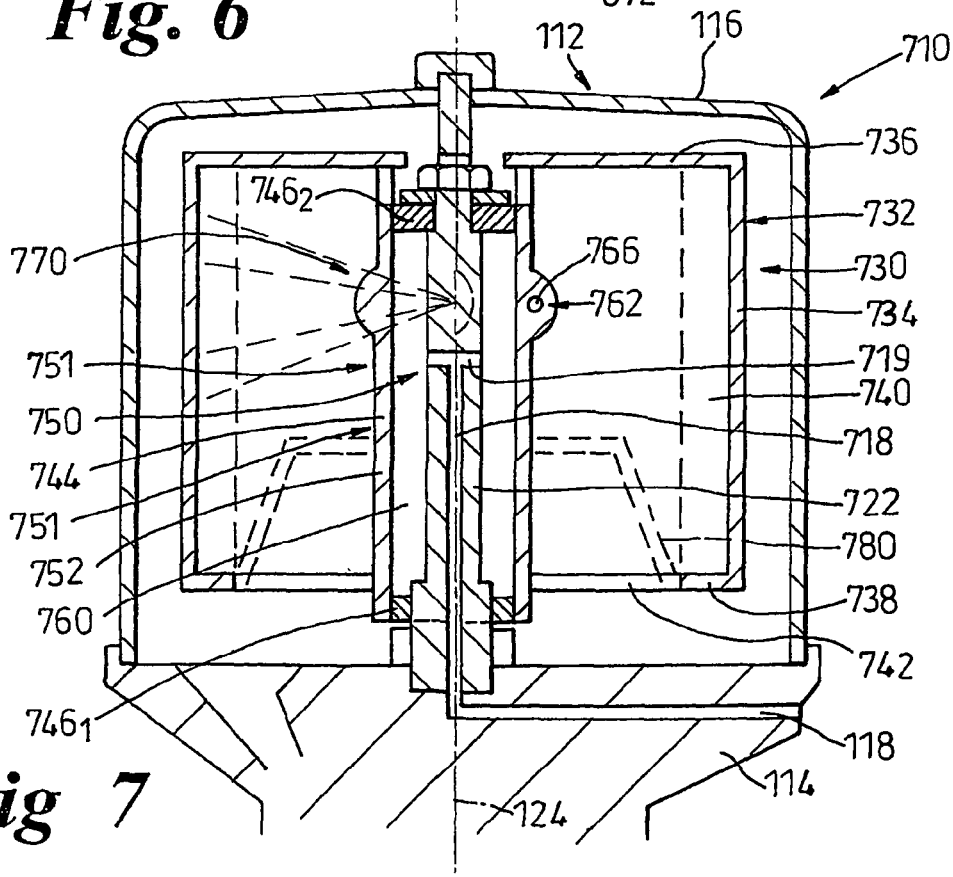
FIG. 7 is a sectional elevation through a seventh embodiment of centrifugal separation apparatus in accordance with the invention including reaction turbine drive means.

It will be appreciated that insofar as the rotor means is operated with relatively little liquid therein, it may be spun at high speed using the contaminated liquid pressure by drive means other than an impulse turbine, such as the more traditional reaction turbine. Referring to FIG. 7, a seventh embodiment of centrifugal separator 710 is shown in sectional elevation and once more, previously described parts have the same reference numbers whilst parts unique to the embodiment have reference numbers with a leading "7". The housing 112, with base 114 and cover 116, as described above. Spindle 722 corresponds to the above-described spindle 122 except that it has the supply duct 118 extending therealong axially as inlet passage 718 to cross drillings 719.

Rotor means 730 is mounted on the spindle by way of bearing bushes $746_1$ and $746_2$ disposed at opposite ends of tubular axle 744. The tubular axle is surrounded by a walled separation and containment vessel 732 defined by an outer side wall 734 spaced therefrom by end walls 736 and 738, the wall 738 including outlet passage means 742 positioned radially to define contaminant separation and containment zone 740. The tubular axle 744 provides both inlet means, indicated generally at 750, and drive means, indicated generally at 770.

In respect of the inlet means, the tubular axle comprises an effective divider wall 752 of collection means 751 and defines with the spindle an annular inlet region 760 fed by way of the passage 718. The tubular axle/divider wall is also provided with transfer aperture means 762 in the form of a plurality of apertures 766. In respect of the drive means 770, the apertures 766 comprise tangentially directed jet reaction nozzles, which eject contaminated liquid from the inlet chamber and by reaction thereto cause the rotor means to spin about the spindle.

Thus, the reaction nozzles spray ejected liquid, spent of most but not all of its energy, in a direction away from the rotation axis of the rotor means, which liquid impinges upon the vessel outer wall 734 and spreads thereon as a film overlying the wall, and subsequently overlying contaminants separated from the liquid, within the zone 740 as described above. Insofar as the divider wall is spaced from the boundary of the zone 740 and the outlet passage means defining the zone, and there exists a risk of deposited contaminants falling from a filled vessel when it is not rotating, it may be desirable to define a floor to the vessel radially inwardly of the outlet passage means, as shown by broken lines 780 or define the outlet passage means at an upwardly facing end, that is, in end wall 736 rather than end wall 738.

It will be appreciated from the Figure that the high pressure liquid in inlet region 760 also provides lubrication for the bearing bushes 746, and $746_2$ and some of the liquid escapes through the bushes directly into the housing without passing through transfer passage nozzles 766. It is possible to treat such liquid in respect of separation as also supplied to vessel 732 by extending the side wall 734 to beyond one bush bearing as shown for end wall 736, or both bearings.

It also will be appreciated that although the inlet region 760 within the axle tube is filled with liquid and the effect thereof, in terms of the need to effect substantial sealing of the axle chamber on the spindle by the bearing bushes (or otherwise) and the lower efficiency of reaction jet turbine, is an improvement over existing reaction driven separation arrangements because the liquid is confined to smaller radially inner and outer proportions of the rotor means.

Figure 8:
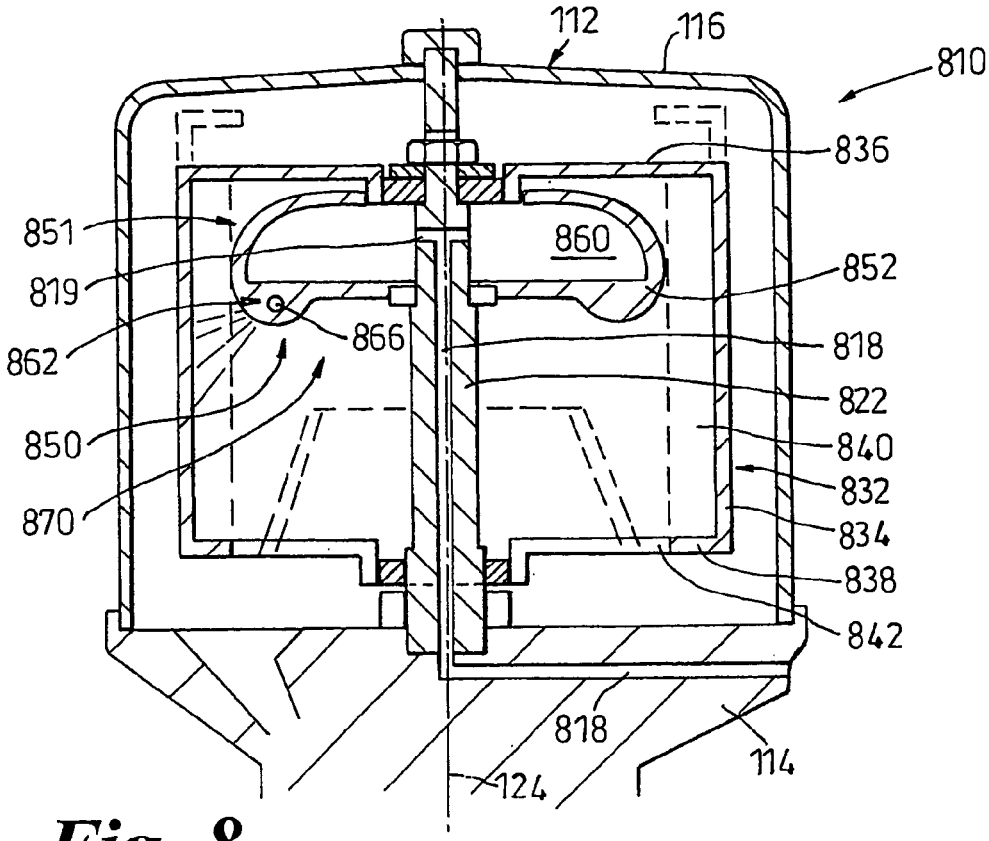
FIG. 8 is a sectional elevation through an eighth embodiment of centrifugal separation apparatus in accordance with the invention illustrating a further variant of reaction turbine drive means, the spent liquid of which is the source of contaminated liquid to be cleaned.

Referring now to FIG. 8 this shows a sectional elevation an eighth embodiment of centrifugal separation arrangement in accordance with the present invention, and a variant of the seventh embodiment, at 810. Within housing 112, fixed spindle 822 has a supply duct 818 for incoming contaminated liquid at elevated pressure and has mounted rotatably thereon a walled separation and containment vessel 832 defined by radially outer wall 834 and end walls 836 and 838, in the latter of which is formed outlet passage means 842 that defines a contaminant separation and containment zone 840 adjacent the wall 834. The radially inner boundary of the vessel is the spindle, that is, there is no separate tubular axle, although there could be if desired. As in the previous embodiment, the arrangement combines inlet means, which is here indicated generally at 850, and drive means, indicated generally at 870. The vessel 832 is divided internally at least in part by a radially extending divider wall 852 which forms annular inlet chamber 860 surrounding the spindle and fed by way of the duct 818 and cross drilling 819. In respect of inlet means, the divider wall 852 is also provided with transfer aperture means 862 in the form of a plurality of apertures 866 by way of which contaminated liquid is directed to the zone 840. In respect of the drive means 870, the apertures 866 comprise tangentially directed jet reaction nozzles, which eject contaminated liquid from the inlet chamber towards the zone 840, and by reaction thereto cause the rotor means to spin about the spindle, enabling separation of contaminants to be effected in the zone 840 at the radially outermost part of the vessel.

The inlet chamber 860 thus comprises a drive chamber and may be of small volume sufficient to function as a reaction turbine to rotate the other vessel 832 at high speed and preferably is shaped to encourage contaminated liquid passing therethrough to do so without separation of contaminants. The major part of the vessel 832 which receives the ejected and spent liquid directed towards its outer wall, is not filled with the liquid but in operation contains only a relatively small amount as dictated by the contaminant separation and containment zone.

Figure 9:
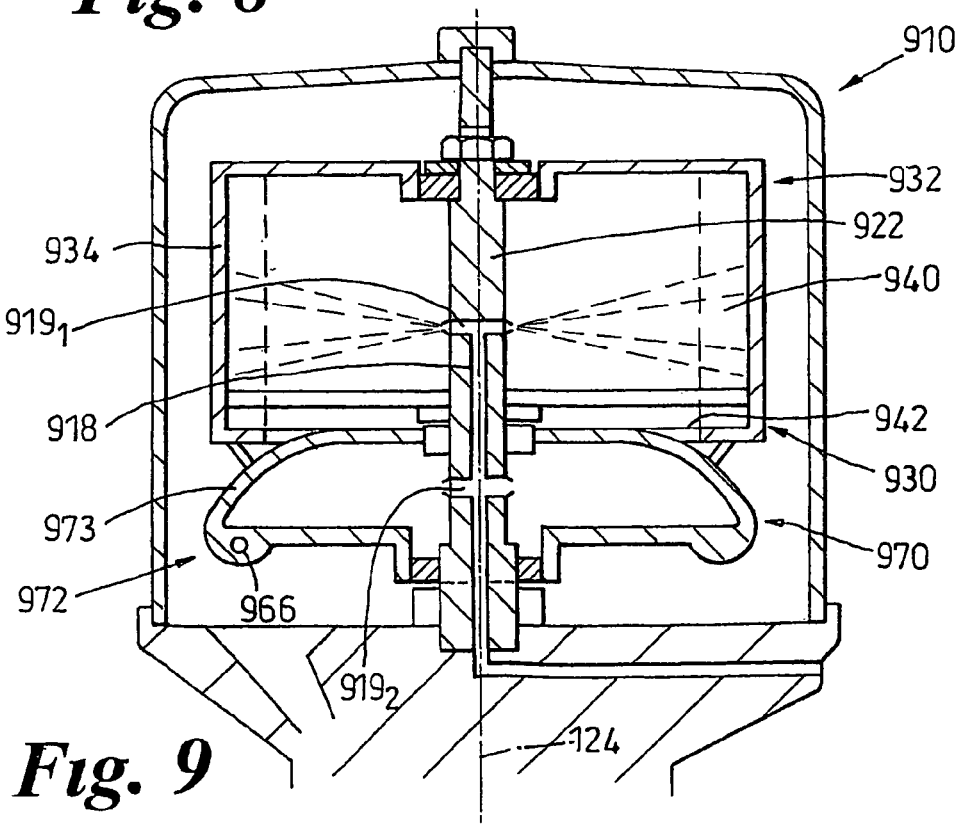
FIG. 9 is a sectional elevation through a ninth embodiment of centrifugal separation apparatus in accordance with the invention illustrating a further variant of reaction turbine drive means in which the spent liquid is not the source of the contaminated liquid to be cleaned.

Referring now to FIG. 9, this shows in sectional elevation a ninth embodiment of centrifugal separator 910.The arrangement is somewhat similar to the eighth embodiment in having rotor means 930 in the form of a pair of axially disposed, rotationally coupled vessels defined about spindle 922, one of which, 932, defines contaminant separation and containment zone 940 and the other of which comprises drive means 970.

Inlet means to the vessel 932 comprises spindle duct 918 and cross drilling $919_1$ which preferably contains some form of diffusing means (not shown) to spay the liquid towards the outer wall 934, where it forms a layer only to the thickness of the contaminant separation and containment zone 940 defined by outlet passage means 942.

Drive means 970 comprises a reaction jet turbine 972 formed by vessel 973, closed except in respect of liquid inlet from the spindle by way of cross drilling $919_2$ and liquid outlet by way of reaction jet nozzles 966 in the vessel wall. The vessel 973 has small volume, sufficient to function as a reaction turbine to rotate the other vessel 932 at high speed and preferably is shaped to encourage contaminated liquid passing therethrough to do so without separation of contaminants.

Insofar as the contaminated liquid supplied to the contaminant separation and containment zone is separate from that employed to rotate the rotor means, the relative flow rates may be chosen having regard to maximising the rotation rate whilst providing a relatively long residence time in the contaminant separation and containment zone.

In accordance with the spirit of the present invention the above described reaction turbine drive chamber 860 and vessel 973 each has a small, but nevertheless significant volume. It will be appreciated that if desired, such a reaction drive may be defined without filtering such a chamber per se, that is, with minimal volume, by means of discretely feeding the reaction jet nozzles by individual ducts in the manner set out in U.S. Pat. No. 5,906,733.

It will be appreciated that although all of the above described embodiments have shown the outlet passage means defined at the lower wall of the rotor vessel in relation to a vertical rotation axis, this is not a functional necessity. The outlet passage means may be defined in the upper end wall or radially outer wall or any combination thereof, provided that the contaminant separation and containment zone is properly defined and liquid exiting the vessel by way of the outlet passage means does not interfere with the rotation. In this context the impervious nature of the radially outer wall should be taken to be exclusive of such outlet passage means. Likewise, depending upon the drive means, it may be possible to operate with the rotation axis at any non-vertical orientation.

Furthermore, although all of the above embodiments have been described with a stationary spindle, such may be rotatably mounted with respect to the housing for rotation about the axis 124, a discrete tubular axle 124 being then unnecessary. Furthermore, spindle means may comprise a pair of axially spaced stub axles at opposite ends of the housing and carried by, or extending into, the rotor means.

Figure 10:
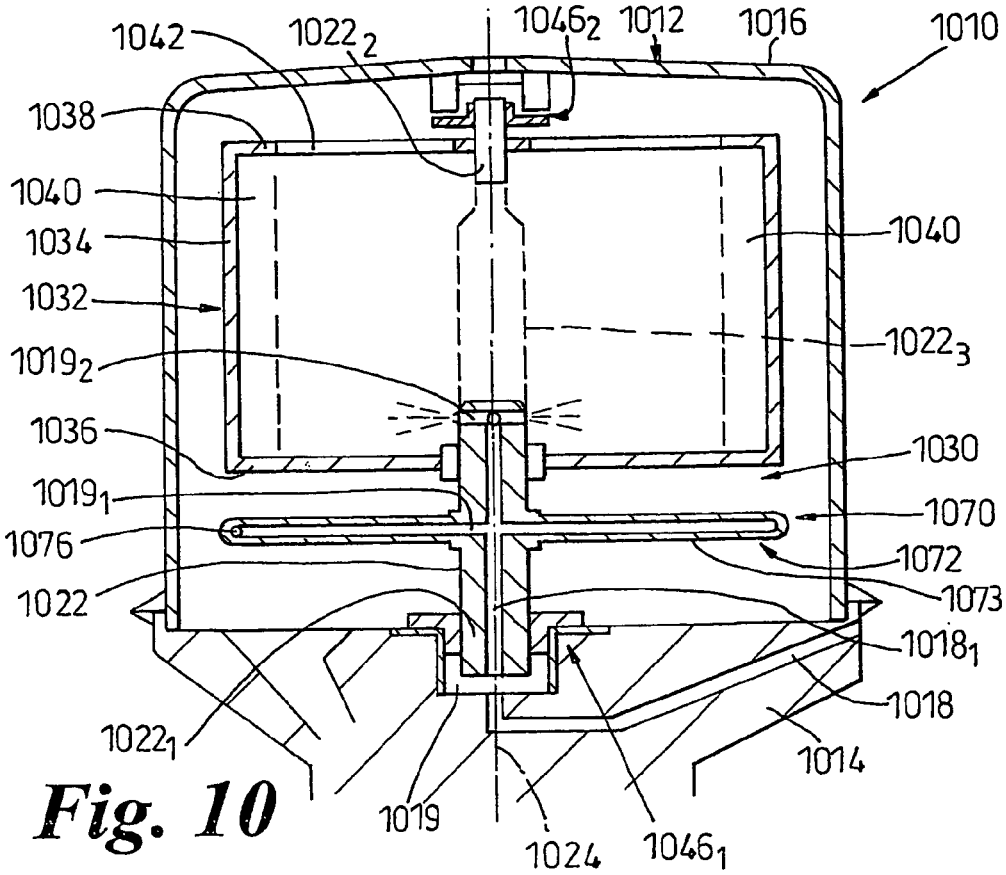
FIG. 10 is a sectional elevation through a tenth embodiment of centrifugal separation apparatus in accordance with the invention, illustrating further variants to the rotor means.

Referring now to FIG. 10, this shows in sectional elevation a tenth embodiment of centrifugal separation arrangement 1010 in accordance with the present invention. Housing 1012 is defined by base 1014 and removable cover 1016. The base includes inlet duct means 1018 and recess 1019 for supporting one end $1022_1$ of spindle 1022 for rotation with respect thereto by way of bearing means $1046_1$. The supply duct opens into the recess 1019 and the spindle contains a duct $1018_1$ extending therealong from the end and in communication with the supply duct by way of the recess. A further spindle $1022_2$ is mounted by way of bearing means $1046_2$ to the cover 1016 for rotation relative to the common longitudinal axis 1024. The spindles form part of rotor means indicated generally at 1030. The spindle duct $1018_1$ connects to a pair of axially spaced cross drillings $1019_1$ and $1019_2$. Mounted on the spindle $1022_1$ in alignment with the cross drilling $1019_2$ is a vessel 1032 having an impervious outer wall 1034 extending about and along the axis 1024 and displaced therefrom by end wall 1036 which is fixed permanently, or releasably threaded, to the spindle $1022_1$. At the other end of the outer wall 1034, end wall 1038 is connected to the spindle $1022_2$ but apertured at a predetermined distance from the rotation axis to define outlet passage means 1042, and thereby contaminant separation and containment zone 1040. The rotor means also comprises drive means 1070 in the form of reaction turbine means 1072, comprising a plurality of stand pipes 1073 each aligned with the cross drilling $1019_1$ and terminating adjacent the cover 1016 in a jet reaction nozzle 1076.

Operation is essentially as described above in relation to the seventh, eighth and ninth embodiments driven by reaction turbines but with minimal liquid contained in the rotor means for minimum inertia. Also, this embodiment illustrates the outlet passage means at the upper end of the housing. The spindle ends $1022_1$ and $1022_2$ may of course, comprise end regions of a single spindle 1022 as shown by the broken joining lines $1022_3$.

It will be appreciated that outlet passage means may be disposed at such "upper end" of the separation and containment vessel in any of the above described embodiments, or indeed at both ends.

All of the embodiments described above have employed drive means in the form of impulse or reaction turbines which are powered by the contaminated liquid either separately from or as a precursor to it undergoing contaminant separation, this being one of the most convenient power sources available to such arrangement within a functioning internal combustion engine. It will be appreciated that there are numerous other forms or turbines or non-turbine motors driven by liquid or gaseous fluids that could be adapted for an arrangement in accordance with the present invention. Also, insofar as the arrangement is capable of being designed to effect centrifugal cleaning of contaminated liquid separately from driving the rotor means, the drive means does not need to be powered by the contaminated liquid, nor indeed liquid or any other fluid at all. For example, the rotor means could be driven by electric motor means or mechanical linkage to an engine whose lubricant is being cleaned and achieve high rotation speeds by way of gearing.

Other structural variations are possible. For instance, the inlet means may be displaced axially from the separation and containment vessel, particularly where the inlet means directs incoming liquid axially to a transfer passage and the transfer passage shares the same axial position at at least one end of the vessel.

Although for optimum conditions of minimal inertia and separation radius, the separation and containment vessel comprises little more than a radially impervious wall at maximum distance, it will be appreciated that if it anticipated that only a minor proportion of the particulate contaminants are of such low density as to require these conditions, then it may be feasible to include coaxially within the vessel, radially between the outer wall and the rotation axis, one or more nested further vessels having substantially the same structure, in terms of outlet passage means defining a contaminant separation and containment zone adjacent an impervious radially outer wall, but each providing by such outlet passage means the liquid for the next outer vessel.

Figure 11:
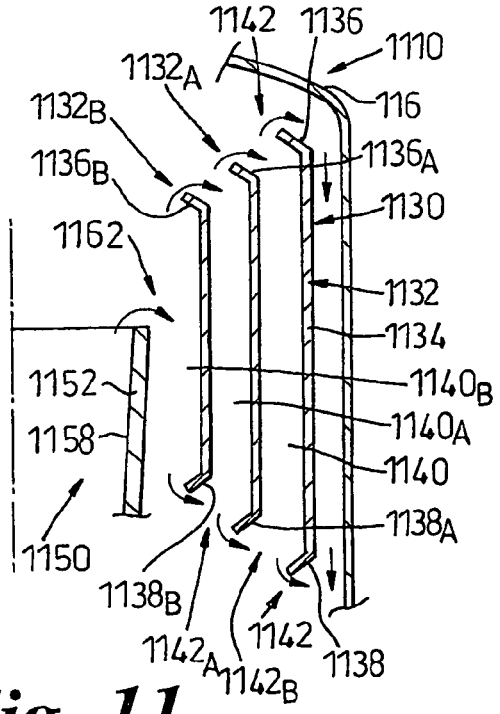
FIG. 11 is a schematic representation in sectional elevation of part of an eleventh embodiment of centrifugal separator in accordance with the invention, illustrating the inclusion of further vessels within the walled contaminant separation and containment vessel.

Referring, now to FIG. 11, this shows a schematic representation in sectional elevation of part of a an eleventh embodiment of centrifugal separation apparatus 1110 in accordance with the invention, and based upon the embodiment 210 to which reference is made for the parts not shown. The Figure does show a portion of (static) cover 116 enclosing rotor means 1130.

The rotor means comprises inlet means 1150, in the form of tapered divider wall 1152 having radially inwardly facing collector face 1158, and, adjacent the end thereof, transfer passage means 1162, as well as separation and containment vessel 1132 mounted thereto by radially extending spacer spars (not shown) for rotation therewith. The vessel 1132 comprises axially extending, impervious wall 1134 and at each end thereof vestigial end walls 1136 and 1138 which are directed both axially and radially to collect liquid approaching in a radial direction and to define the radial limit of a contaminant separation and containment zone 1140, that is, the radial limit of outlet passage means 1142.

Also mounted on, and coaxially with, the inlet means are a plurality, here two, of further separation and containment vessels $\mathbf{1132}_A$ and $\mathbf{1132}_B$ radially inwardly of the vessel 1132. The further vessels are substantially identical to the vessel 1132 in having vestigial end walls $\mathbf{1136}_A$, $\mathbf{1138}_A$, $\mathbf{1136}_B$ and $\mathbf{1138}_B$ that define outlet passage means $\mathbf{1142}_A$, $\mathbf{1142}_B$ and thereby contaminant separation and containment zones $\mathbf{1140}_A$ and $\mathbf{1140}_B$ respectively, but also are progressively shorter in axial length towards the inlet means so that liquid exiting the outlet passage means of each is flung radially outwardly towards, and collected by, the next vessel. As can be seen, the transfer passage 1162 of the inlet means is aligned substantially with the mid points of the surrounding vessels.

Operation will be seen to correspond to that described above with each vessel or further vessel containing a relatively thin, annular skin of liquid and contaminants separated therefrom having densities appropriate to the distance from the axis, progressively cleaner liquid with lower density contaminants eventually arriving at the outermost vessel 1132. Insofar as each of the further vessels may be made of low density, synthetic resin materials (i.e., plastics), the weight, and thus inertia of the multi-vessel rotor means, can still be significantly less than a single vessel completely filled with liquid.

Figure 12:
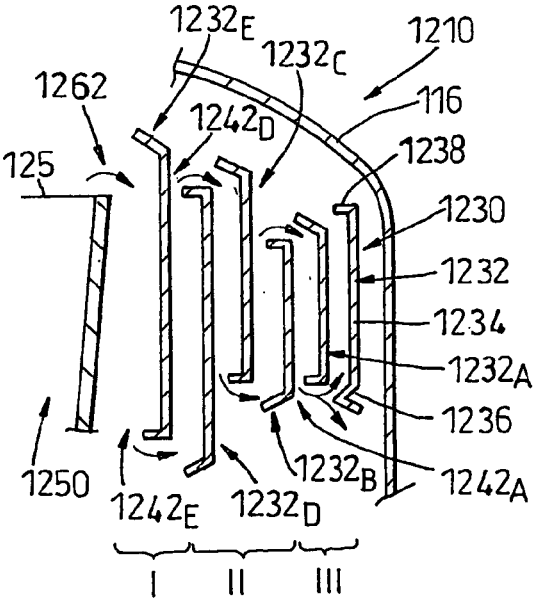
FIG. 12 is a schematic representation in sectional elevation of part of a twelfth embodiment of centrifugal separator showing modification of the multi-vessel arrangement of FIG. 11.

There are may structural variations possible in terms of the size and dispositions of such further vessels and FIG. 12 illustrates some of these in a composite construction of such a schematic part view of separation apparatus 1210. Referring to the Figure, the outer cover 116 and inlet means 1250 is substantially as described above. Rotor means comprises an outermost separation and containment vessel 1232 and coaxially therein, a plurality of spaced apart further vessels $\mathbf{1232}_i$, where i is here A to E.

Considering the further vessels $\mathbf{1232}_E$ and $\mathbf{1232}_D$ that make up section I, these (and possibly all vessels) are of uniform length, but the outlet passage means $\mathbf{1242}_E$ and $\mathbf{1242}_D$ is defined at one end only of each, which end alternates for successive vessels so that the liquid follows a meandering path along the full length of each.

Considering the further vessels $\mathbf{1232}_D$, $\mathbf{1232}_C$ and $\mathbf{1232}_B$ that make up section II, these (and possibly all vessels) are progressively shorter with distance from the rotation axis as well as being disposed axially to effect a meandering path for the liquid. Such arrangement has the functional effect of minimising the inertia of the rotor means and permitting a more tapered, streamlined shape for the cover.

Consider the further vessel $\mathbf{1232}_A$ and vessel 1232 that make up section III, these (and possibly all vessels) have at the end where liquid is received from the outlet passage means $\mathbf{1242}_A$ of the preceding further vessel an end wall 1236 which is shaped as a splitter to divert only a proportion of the liquid into the vessel.

It will be appreciated that where one or more further vessels are employed nested within the outer vessel, the outer side walls need not extend parallel to that of the outer vessel. Likewise, although each outlet passage means and further outlet passage means has been shown in an end wall of each vessel or further vessel, it may be provided in an appropriately shaped side wall.

It is a fundamental feature of all of the embodiments described above that the separation and containment vessel defined by, and radially inwardly of, the impervious radially outer side wall, is not filled with liquid and has a relatively thin contaminant separation and containment zone adjacent the wall and as such provides a structure wherein the radial position of the outer wall is not a determining factor in the bulk of the liquid contained and rotated and is free of centrifugal pressure gradient flow behaviors of such liquid.

These operating principles thus enable completely novel constructions of rotor means for this type of engine lubricant cleaning arrangement which is readily substituted within the "real estate" made available on such an engine for cleaning by the traditional arrangements.

However it will be appreciated that there are circumstances in which a walled separation and contaminant vessel as defined by a liquid filled canister is, notwithstanding the above outlined conflicts regarding diameter and separation force, nevertheless optimized dimensionally for removing all but the lowest density contaminants, such as soot, and providing an adaptation which builds upon such optimization to increase the range of particulate separation whilst avoiding the conflict is desirable and within the purview of the present invention.

An essentially non-filled, walled separation and containment vessel in accordance with the present invention may be defined radially outwardly of, and conveniently surrounding a part of, such a closed separation canister for rotation therewith, providing a means of centrifugal separation forces at maximum radius and maximum effective residence time because of the shallow contaminant separation and containment zone whilst not significantly increasing the volume of liquid contained in, and thus the inertia of, the main, reaction driven separation vessel.

Expressed in accordance with the positional relationships described hereinbefore, the further separation and containment vessel, the canister, may be said to be disposed having outlet passage means and inlet passage means operable to attempt to convey liquid to the vessel at a rate greater than it can pass through having greater flow capacity than the outlet passage means to convey liquid to the vessel and maintain it filled in operation, and an impervious radially outer side wall extending around and along the rotation axis and forming an annular contaminant separation and containment zone extending radially inwardly from the side wall.

The canister may simply sit between the contaminant separation and containment zone and the rotation axis, analogous to those described in the eleventh and twelfth embodiments in providing fluid rotor means for, and physically coupling the outer vessel rotation but with said radially outer side wall arranged to extend along the axis and upon which contaminants are deposited, operating on different (denser) parts of the contaminated liquid supplied to the separation apparatus.

Figure 13:
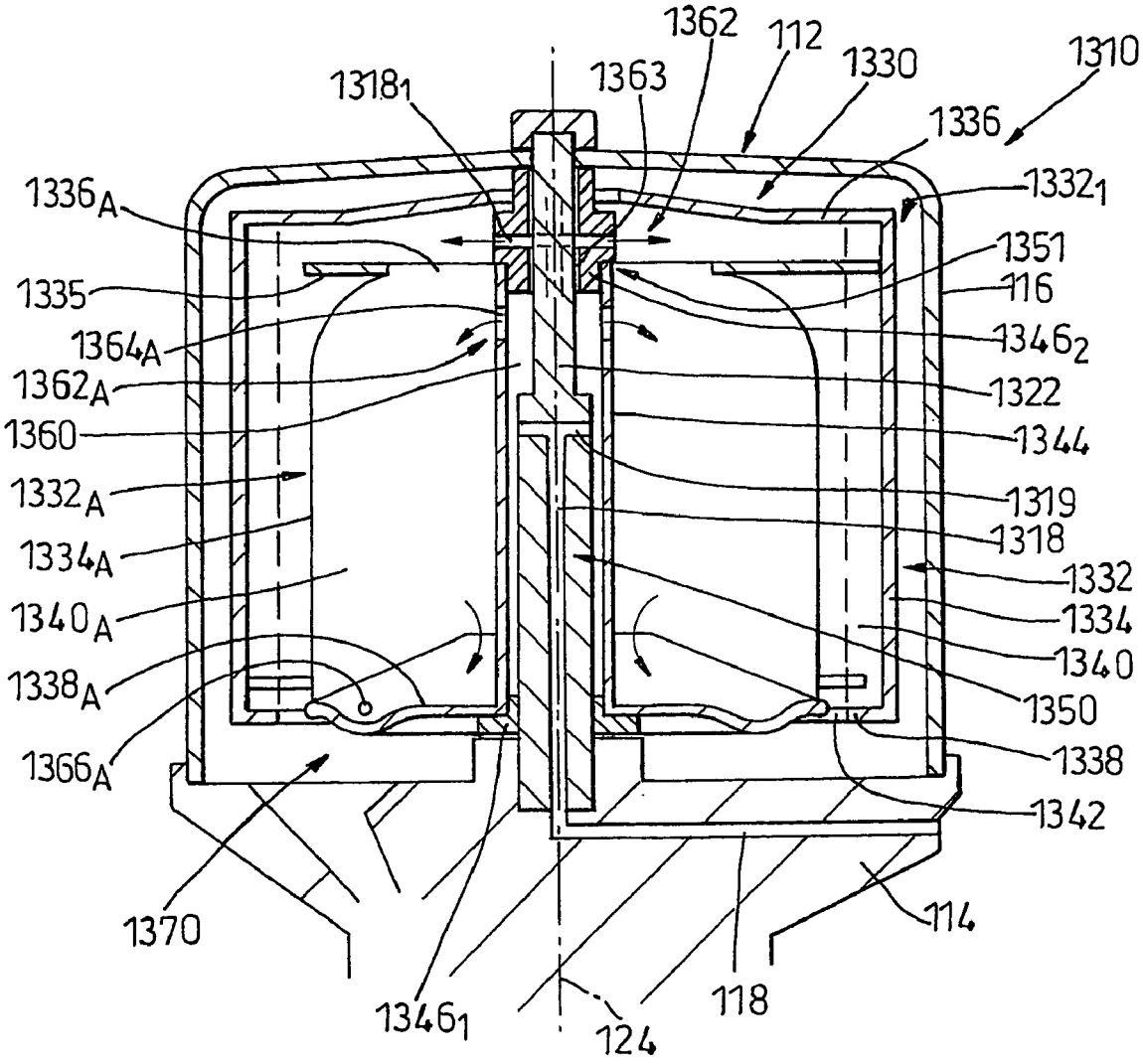
FIG. 13 is a sectional elevation through a thirteenth embodiment of centrifugal separator in accordance with the present invention in which, within the walled contaminant separation and containment vessel, a further contaminant separation and containment vessel is provided in the form of a conventional, liquid filled canister that also provides the drive means.

Referring now to FIG. 13, a thirteenth embodiment 1310 of centrifugal separation apparatus in accordance with the present invention is shown in sectional elevation, comprising the common features of housing 112 defined by base 114, cover 116 and rotation axis 124, in addition to inlet duct 118 extending through the base. It also has spindle 1322 fixed to, and extending from, the base along rotation axis 124 and along which spindle the housing inlet duct 118 extends as passage 1318 to cross drilling 1319. Rotor means 1330 includes at least part of bearing means 1346 arranged to mount the rotor means on the spindle by way of a tubular axle 1344 and more particularly bearing bushes $\mathbf{1346}_1$ and $\mathbf{1346}_2$ disposed at opposite ends of the tubular axle arrangement to interface with the spindle 1322 and be lubricated by liquid at elevated pressure.

As described briefly in respect of the seventh embodiment, the region 1360 between the spindle and tubular axle is supplied with liquid at high pressure and some of this is forced to pass through the interface 1364 between the bushes and spindle to lubricate them, thereafter being flung radially outwardly by the rotation.

The rotor means 1330 comprises a walled separation and containment vessel 1332 defined by outer side wall 1334 and end walls 1336 and 1338, the former being positioned axially to collect liquid flung outwardly by the bearing bush $\mathbf{1346}_2$ and the latter defining outlet passage means 1342. The outlet passage means in turn defines within wall 1344 contaminant separation and containment zone 1340.

In keeping with the terminology employed hereinbefore, the tubular axle comprises inlet means, indicated generally at 1350, and the region 1360 the inlet region. Also the interface gap 1363 between the bush $\mathbf{1346}_2$ and spindle through which liquid passes to the vessel wall 1334 may be considered as transfer passage means 1362.

Within the vessel 1332, and supporting it with respect to the bearing bushes, is a further separation and containment vessel $\mathbf{1332}_A$ comprising an impervious outer side wall $\mathbf{1334}_A$ extending substantially parallel to the wall 1334 but spaced from both the zone 1340 and the tubular axle and joined to the latter by end walls $\mathbf{1336}_A$ and $\mathbf{1338}_A$, which walls define an essentially closed annular volume $\mathbf{1340}_A$ for containing liquid at elevated pressure.

The further vessel $\mathbf{1332}_A$ is essentially a rotor canister as employed in prior separation apparatus and has associated therewith further transfer passage means, indicated generally at $\mathbf{1362}_A$, comprising one or more through apertures $\mathbf{1364}_A$ which couple the canister volume, and the pressure therein, to the inlet region 1360, and further outlet passage means $\mathbf{1342}_A$, in the form of one or more tangentially directed reaction nozzles $\mathbf{1366}_A$ in the canister end wall $\mathbf{1338}_A$, which couple the canister volume to the housing. The further vessel $\mathbf{1332}_A$ differs from the vessel 132 also in that the further outlet passage means, as defined by the reaction nozzles $\mathbf{1366}_A$ has such flow capacity that it is not capable of passing liquid from the vessel at a greater rate than it is conveyed thereto, on this case from the pressurized source so that in operation the canister rapidly fills with, and is maintained filled with, the liquid. Thus in known manner the high pressure of liquid entering the canister is exchanged as it leaves through the nozzles for a reaction force that rotates the canister and tubular axle about the axis 124, and, in doing so, subjects the liquid within the canister volume to centrifugal forces which cause solid contaminants to migrate towards the outer wall and be deposited thereon as a cohesive layer. That is, the canister volume $\mathbf{1340}_A$ defines a further contaminant separation and containment space $\mathbf{1340}_A$ adjacent to, and extending radially inwardly from, the radially outer wall $\mathbf{1334}_A$.

As a consequence of the further vessel canister being filled with the liquid at elevated pressure derived from the supply to effect rotation, and as outlined in the introduction to this specification, the liquid passing therethrough also has a rotation related radial pressure gradient that limits the density of contaminant particles that can efficiently migrate to the outer wall and the effective radius thereof practicable for any particular through-flow rate and rotation speed available thereby. However, known design criteria can provide such canisters that efficiently remove significant, particularly dense, contaminants at modest and readily attainable angular speeds and radii, and the further vessel $\mathbf{1332}_A$ functions to provide for such separation.

Notwithstanding the limitations of the further vessel in terms of particle density it can efficiently separate, insofar as it includes reaction turbine drive means and the vessel 1332 is supported coaxially thereabout, the further vessel $\mathbf{1332}_A$ thus comprises, indicated generally at 1370, drive means for the vessel 1332 and such vessel provides simply and efficiently increased radius and longer effective residence time for a proportion of the liquid that enables separation of low density particles without significantly increasing the overall inertia of the rotor means by containing more liquid in an enlarged canister.

The means by which the vessel 1332 and further vessel $\mathbf{1332}_A$ are juxtaposed and mounted with respect to the spindle is open to variation, but as illustrated, the vessel 1332 has, optionally, the skeletal, removable separation and containment module form $\mathbf{1332}_1$ similar to that 132, of FIG. 1, which permits it to be releasably attached to, and removed from, the further vessel $\mathbf{1332}_A$ by way of 'spider' limbs and, enables such a vessel to be formed that is capable of being retro-fitted to existing centrifugal separation canisters, particularly where, as shown in FIG. 13, the liquid inlet comprises an existing outflow from bearing means that requires no modification of the spindle or canister of the existing apparatus.

However, modification may be employed to optimize operation ranging form relatively simple measures, such as surface features in the bearing bush surfaces to facilitate delivery of liquid to the vessel 1332 at a rate that is more consistent with, but still less than, the rate at which it can leave by the outlet passage means 1342; or from a specific passage $\mathbf{1318}_1$ in the spindle, including the possibility of being from a different supply source and/or at different pressure from that required to make the further vessel $\mathbf{1332}_A$ rotate; or by way of one or more through-apertures in a wall of the further vessel canister, either specific to, and dimensioned for, this purpose or the reaction jet nozzles 1366 analogously to the seventh and eighth embodiments.

It will also be appreciated that insofar as the further vessel $\mathbf{1332}_A$ operates filled with liquid at the same pressure as inlet region 1360, the tubular axle 1344 is not essential to the functionality, although offering structural strength to the further vessel. Therefore, in appropriate circumstances the further vessel may be formed absent such tubular axle, in the manner of the eighth embodiment.

It will be understood that whilst a convenient and compact arrangement may be formed by disposing the liquid filled further separation and containment vessel within the partially filled vessel, this may be disposed coaxially and coupled but separated axially. In particular the partially filled vessel need not have separation and containment zone at a greater radial distance than that of the fully filed canister if the desire to increase the capacity for separating particles of the same density without significantly increasing the weight of liquid rotated.

The foregoing description and examples have been set forth merely to illustrate the invention and are not intended to be limiting. Since modifications of the described embodiments incorporating the sprit and substance of the invention may occur to persons skilled in the art, the invention should be construed broadly to include all variations within the scope of the appended claims and equivalents thereof.

What is claimed is:

1. A centrifugal separation rotor for a centrifugal separator for separating solid contaminants from a liquid, said separator comprising a housing for mounting the rotor for rotation about a rotation axis by a drive, said rotor comprising:

a walled separation and containment vessel having an impervious radially outer side wall extending about and along the rotation axis to form radially inwardly from the side wall an annular contaminant separation and containment zone, an outlet passage, disposed radially inwardly with respect to the radially outer side wall and leading externally of the vessel, and, associated with the vessel rotation axis, an inlet for conveying liquid to be cleaned to the contaminant separation and containment zone at a rate less than the liquid can be discharged by the outlet passage, said inlet comprising a liquid collector defining an inlet region about the, and a transfer passage communicating between the inlet region and the contaminant separation and containment zone of the vessel spaced axially from the outlet passage, the outlet passage being disposed to define radially outwardly of the transfer passage during rotation a radial boundary of the contaminant separation and containment zone, wherein the liquid collector comprises a divider wall, extending about and along the rotation axis and defining at least in part at one end thereof the transfer passage, having a liquid collection face, facing towards the rotation axis, arranged to receive liquid introduced into the inlet at a part spaced axially from the transfer passage and operable to support the liquid radially in response to centrifugal force exerted by rotation, permitting it to flow along the wall to the transfer passage, and wherein the divider wall collection face increases in radial distance from the rotation axis along its length from the liquid introduction part to the transfer passage, the increase being arranged to cause, in operation, a component of the centrifugal force to confine axial flow of the contaminated liquid over the collection face in a direction towards the transfer passage.

2. A centrifugal separation rotor according to claim 1, wherein said rotor comprises a drive formed by a fluid motor arranged to be driven by liquid at elevated pressure, and the liquid collector is arranged to receive spent liquid from the fluid motor.

3. A centrifugal separation rotor according to claim 1, wherein said rotor comprises a drive comprising an impulse turbine having blades fixed to the rotor surrounding the rotation axis, said blades being arranged to be struck by at least one stream of liquid from the source of contaminated liquid to be cleaned directed from at least one stationary feed nozzle and to direct spent liquid onto the collection face.

4. A centrifugal separation rotor according to claim 1, wherein the rotor comprises a drive formed by a fluid motor comprising a reaction turbine having a plurality of jet reaction nozzles carried by the rotor.

5. A centrifugal separation rotor according to claim 1, wherein the rotor includes bearing means for mounting the rotor with respect to the separator housing for rotation, and at least the radially outer wall of the separation and containment vessel, and the contaminant separation and containment zone defined by the vessel, comprises a separation and containment module releasably attached to the inlet.

6. A centrifugal separation rotor according to claim 5, wherein the separation and containment module is attached to, and supported by, an end of the divider wall.

7. A centrifugal separation rotor according to claim 5, wherein the separation and containment module is made of a molded synthetic resin material.

8. A centrifugal separation rotor according to claim 1, wherein the rotation axis of the rotor is substantially vertical, and the transfer passage is arranged above the liquid introduction part of the inlet such that rotation of the collection face causes contaminated liquid introduced to the collection face to climb the face towards the transfer passage.

9. A centrifugal separation rotor according to claim 1, wherein the collection face of the divider wall diverges smoothly from the rotation axis as a function of distance along the rotation axis.

10. A centrifugal separation rotor according to claim 9, wherein the divergence is substantially linear as a function of axial distance.

11. A centrifugal separation rotor according to claim 1, further comprising at least one further separation and containment vessel associated with said separation and containment vessel and nested radially inwardly of the contaminant separation and containment zone, said further separation and containment vessel having an impervious radially outer side wall, an annular contaminant separation and containment zone bounded radially inwardly of said side wall by an outlet passage, and an associated inlet arranged to convey liquid to the annular zone at a rate less than the liquid can be discharged the annular zone through the outlet passage, said further separation and containment vessel being disposed such that the outlet passage of each surrounded vessel permits liquid to be conveyed radially by centrifugal forces to the next surrounding vessel.

12. A centrifugal separation rotor according to claim 1, further comprising a further walled separation and containment vessel coupled to said walled containment and separation vessel for rotation therewith, said further walled separation and containment vessel defining a canister having an outlet passage and an inlet passage having greater flow capacity than the outlet passage and capable of admitting liquid to the vessel at a rate greater than it can pass through the outlet passage so that the vessel is maintained filled in operation, and having an impervious radially outer side wall extending around and along the rotation axis and forming an annular contaminant separation and containment zone extending radially inwardly from the side wall.

13. A centrifugal separator for separating solid contaminants from a liquid, said separator comprising a housing, an inlet opening into said housing for supplying contaminated liquid to said housing at elevated pressure, an outlet for discharging cleaned liquid from said housing, a rotor mounted within the housing for rotation about a rotation axis extending through the housing, and a drive for rotating said rotor about the rotation axis, wherein the rotor comprises a centrifugal separation rotor according to claim 1.

14. A centrifugal separation rotor according to claim 1, wherein the radial boundary of the contaminant separation and containment zone is disposed between liquid in the contaminant separation and containment zone and a gaseous atmosphere radially inwardly of the zone.

* * * * *